US006158089A

United States Patent [19]

Monahan et al.

[11] Patent Number: 6,158,089

[45] Date of Patent: Dec. 12, 2000

[54] TELESCOPING HANDLE

[75] Inventors: Patrick Monahan, Arcola; Michael K. Bollan, Charleston, both of Ill.

[73] Assignee: Thomas Monahan Company, Arcola, Ill.

[21] Appl. No.: 09/266,122

[22] Filed: Mar. 10, 1999

[51] Int. Cl.[7] ..... A45C 7/00; A45C 13/22

[52] U.S. Cl. ..... 16/429; 16/405; 16/431

[58] Field of Search ..... 16/431, 113.1, 16/429, 405, 406; 403/377, 109.1, 359.1; 15/144; 43/18.1

[56] References Cited

U.S. PATENT DOCUMENTS

| | | | |
|---|---|---|---|
| 3,596,946 | 8/1971 | Burton | 403/109.1 |
| 4,070,932 | 1/1978 | Jeannotte . | |
| 4,325,157 | 4/1982 | Balint et al. | 16/429 |
| 5,385,323 | 1/1995 | Garelick | 403/109 |
| 5,515,574 | 5/1996 | Larson . | |
| 5,579,557 | 12/1996 | Boden | 16/429 |
| 5,692,856 | 12/1997 | Newman, Jr. et al. | 403/352 |
| 5,924,816 | 7/1999 | Schuele | 403/109.1 |
| 5,951,078 | 9/1999 | Whitehead et al. | 294/54.5 |

*Primary Examiner*—Chuck Y. Mah
*Attorney, Agent, or Firm*—R. William Graham

[57] ABSTRACT

A telescoping handle which is useful for a variety of broom, mop and shovel applications includes a first tubular handle portion having a first end and an inner open surface extending axially inwardly therein from the first end having a predetermined diameter and having at least one aperture surface which extends radially through the first handle portion into communication with the open surface. The telescoping handle includes an annular connector which is fixably disposed on the first end of the first tubular handle portion and includes an inner open surface axially positioned and having a smaller diameter with respect to the open surface of the first tubular portion, wherein the inner open surface of the connector includes at least one guide surface formed therein. A second handle portion is provided which includes an outer extruded surface coating configured in a complementary manner to the inner open surface and guide surface of the connector to be sidably received therethrough. The second handle portion includes a radially outward extendable button which is configured to be removably retainably disposed within the aperture surface of the first tubular handle portion when the second handle portion is disposed within the first tubular handle portion thus locking axial positions of the handle portions.

18 Claims, 1 Drawing Sheet

TELESCOPING HANDLE

BACKGROUND OF THE INVENTION

1. Field of the Invention

The present invention relates to telescoping parts. More particularly, the present invention relates to a telescoping handle for use with brooms, mops and shovels.

2. Related Art

There exist a number of telescoping handles in the art. A principle behind such handles is to enable the length of the handle to be customized to a desirable length for the user. These types of handles typically employ an interlocking feature between two slidably connecting handle pieces. A problem which has existed with such handles is the ability to maintain alignment of the interlocking mechanics, usually a retractable button and hole. Once the button gets out of alignment, it can be lost and the user is required to separate the two parts to find the button.

Some handles have geometric shapes, such as triangular, which when connected maintain alignment of the interlocking mechanics. Other handles provide for a longitudinal slot which runs through the outer handle portion, wherein the button remains slidably disposed in the slot.

While these attempts have met with some success, there continues to be a need for improvement. For example, there is a need to provide a telescoping handle with minimal cost, while providing ease of use and durability. The present invention aims to provide such improvement to the art.

BRIEF SUMMARY OF THE INVENTION

It is an object to improve telescoping handles.

It is another object to increase the ease of use of telescoping handles.

It is still another object to provide a relatively lightweight and durable telescoping handle in an economical manner.

Accordingly, the present invention is directed to a telescoping handle which is useful for a variety of broom, mop and shovel applications. The telescoping handle includes a first tubular handle portion having a first end and an inner open surface extending axially inwardly therein from the first end having a predetermined diameter and having at least one aperture surface which extends radially through the first handle portion into communication with the open surface.

The telescoping handle further includes an annular connector which is fixably disposed on the first end of the first tubular handle portion and includes an inner open surface axially positioned and having a smaller diameter with respect to the open surface of the first tubular portion. The inner open surface of the connector includes at least one guide surface formed therein.

A second handle portion is provided which includes an outer extruded surface coating configured in a complementary manner to the inner open surface and guide surface of the connector to be slidably received therethrough. The second handle portion includes a radially outward extendable button which is configured to be removably retainably disposed within the aperture surface of the first tubular handle portion when the second handle portion is disposed within the first tubular handle portion. Thus, the handle portions are locked in axial position with respect to one another.

Other objects and advantages will be readily apparent to those skilled in the art upon viewing the drawings and reading the detailed description hereafter.

DETAILED DESCRIPTION OF THE INVENTION

Figure 1:
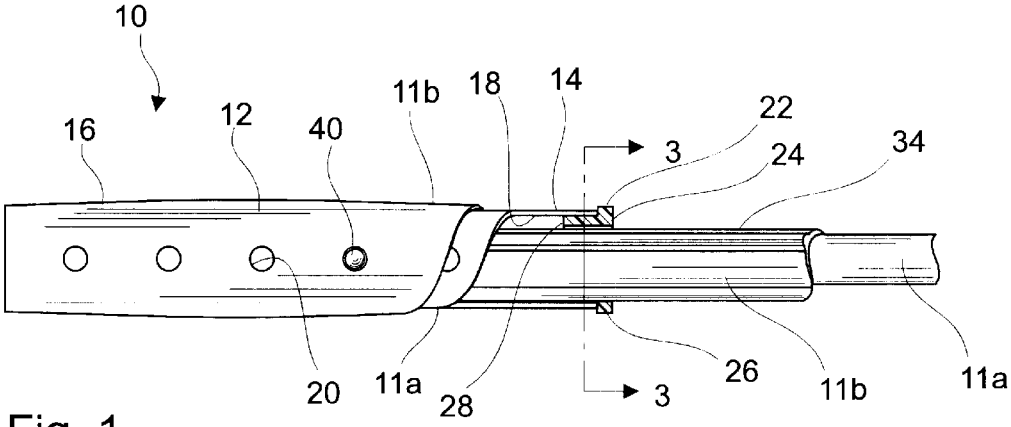
FIG. 1 is a partial sectional view of the present invention.
Figure 2:
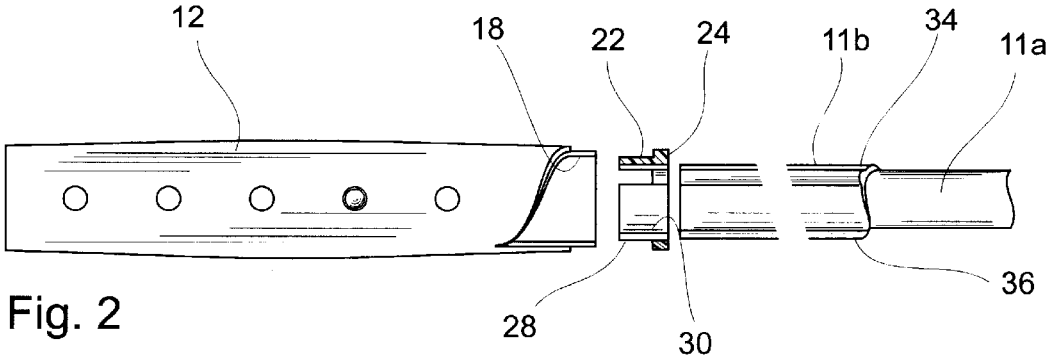
FIG. 2 is an exploded view of the present invention.
Figure 3:
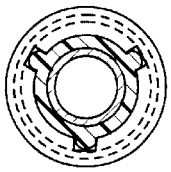
FIG. 3 is a cross sectional view through line 3—3 of FIG. 1.
Figure 6:
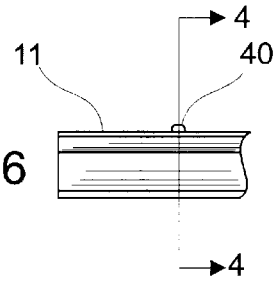
FIG. 6 is a partial view of a part of the invention.
Figure 4:
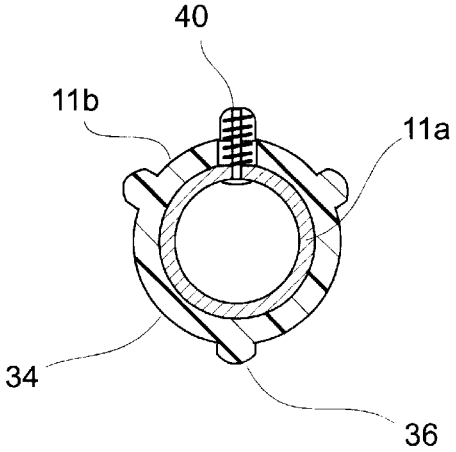
FIG. 4 is a cross-sectional view through line 4—4 of FIG. 6.
Figure 5:
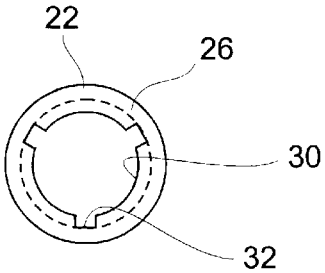
FIG. 5 is an end of a part of the invention.

Referring now to the drawings of the present invention, the telescoping handle is generally referred to by the numeral 10. While the present invention depicts an embodiment of the telescoping handle 10, it is understood that the structure and principles of the invention can be applied to telescoping legs, supports or parts where they so lend themselves. Herein, a telescoping handle 10 is set forth as useful for a variety of broom, mop and shovel applications.

The telescoping handle 10 is preferably made of two complementary materials, a metal inner core material 11*a*, such as an aluminum alloy or a fill hard steel, and a plastic outer covering material 11*b*. The metal core material 11*a* provides lightweight strength to the handle 10. The plastic outer covering material 11*b* provides comfort to the user in handling, as well as advantages of moldability to carry out a guide application as described herein and is applied to the metal via an extrusion process, usually during manufacture of the handle itself and at no significant extra cost for the guide application.

The telescoping handle 10 includes a tubular handle portion 12 having a first end 14 and a second end 16. The tubular handle portion 12 has an inner open surface 18 extending axially inwardly from the end 14 through to the end 16. The open surface 18 has a predetermined diameter, e.g., ¾ inch to an inch. There are a plurality of aperture surfaces 20 which extend radially through the tubular handle portion 12 into communication with the open surface 18. The aperture surfaces 20 are positioned along a common axial line.

The telescoping handle 10 includes an annular connector 22 is preferably made of a plastic material and includes an end 24 formed with a radially extending collar 26 of a diameter approximately the same size or slightly larger than the diameter of the tubular handle portion 12. The connector 22 has another end 28 having an outer diameter just slightly smaller than the diameter of the open surface 18 such that the end 28 may be press fit into the end 14 with the collar 26 acting as a stop such that the connector 22 is fixably disposed on the end 14.

The connector 22 includes an inner open surface 30 which is coaxially positioned with respect to the open surface 18. The inner open surface 30 has a smaller diameter than the open surface 18 and includes at least one recessed guide surface and preferably a plurality of equidistantly spaced recessed guide surfaces 32 formed therein which extend longitudinally from end 24 to end 28 along the inner open surface 30 and are of a depth approximately that of the thickness of the end 24.

A second handle portion 34 is provided which includes outer covering material 11*b* and inner core material 11*a*. Through the extrusion process at least one longitudinal radially extended guide and preferably, a plurality of longitudinal radially extending guides 36 are formed in a complementary manner to the inner open surface 30 and recessed guide surfaces 32 of the connector 22 to be slidably received therethrough. The guides 36 extend radially from a central axis of the second handle portion 34 a distance slightly smaller than a radial distance from a central axis of the first tubular handle portion 12 to the open surface 18. The guides 18 thus serve as a slidable bearing surface.

The second handle portion 34 includes a radially outward extendable button 40 which is spring loaded as is known in the art. The button 40 can be removably retainably disposed within any of the aperture surfaces 20 of the tubular handle portion 12 when the second handle portion 34 is disposed therein thus permitting axial positions of the handle portions 12 and 34 to be locked in place. Upon proper attachment of the connector 22, the recessed guide surfaces 32 and guides 36 serve to keep the button 40 in alignment with aperture surfaces 20 as the handle portions 12 and 34 are axially moved with respect to one another. The connector 22 aids to preclude rotational movement between the first tubular handle portion 12 and the second handle portion 34.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A telescoping handle, which includes:

a first tubular handle portion having a first end and an inner open surface extending axially inward therein from said first end having a predetermined diameter;

an annular connector which is fixably disposed on said first end of said first tubular handle portion and includes an inner open surface axially positioned and having a smaller diameter with respect to said open surface of said first tubular portion, wherein said inner open surface of said connector includes at least one recessed guide surface formed therein;

a second handle portion is provided which includes an outer extruded surface coating said second handle portion characterized to include at least one longitudinal radially extending guide surface formed therein configured in a complementary manner to said inner open surface and to said recessed guide surface of said connector to be slidably received therethrough and prevent rotational movement between said first tubular handle portion and said second tubular portion; and means for axially inlocking said first tubular handle portion and said second handle portion along a common axis when said second handle portion is disposed through said connector and within said first tubular handle portion.

2. The telescoping handle of claim 1, wherein said connector includes a first end of a diameter larger than said open surface of said first tubular handle portion and a second end of diameter slightly smaller than said open surface of said first tubular handle portion and is further characterized to include a plurality of said recessed guide surfaces which are equidistantly spaced and extending longitudinally through said connector along said inner open surface thereof and having a depth approximately equal to a thickness of said second end and wherein said second handle portion is further characterized to includes a plurality of complementary longitudinal radially extending guide surfaces equidistantly spaced to be received within said recessed guide surfaces and are of a radial length to form a bearing surface against said open surface of said first tubular handle portion.

3. The telescoping handle of claim 2, wherein said axially interlocking means includes at least one aperture surface which extends radially through said first handle portion into communication with said open surface and a radially outward extendable button connected to said second handle portion which configured to be removably retainably disposed within said aperture surface of said first tubular handle portion.

4. The telescoping handle of claim 2, wherein said annular connector is press-friction-fit onto said first end in a manner to substantially prevent rotational movement between said first tubular handle portion and said second handle portion.

5. The telescoping handle of claim 4, which is characterized to include a plurality of aperture surfaces in said first handle portion which share a common axis.

6. The telescoping handle of claim 2, wherein said first tubular portion includes an outer extruded plastic surface coating.

7. The telescoping handle of claim 2, wherein said outer extruded surface coating is plastic.

8. The telescoping handle of claim 1, wherein said at least one longitudinal radially extending guide surface is configured in a complementary manner to said at least one recessed guide surface to prevent rotational movement between the first tubular handle portion and the second handle portion.

9. A telescoping member, which includes:

a first tubular member portion having a first end and an inner open surface extending axially inwardly therein from said first end having a predetermined diameter;

an annular connector which is fixably disposed on said first end of said first tubular member portion and includes an inner open surface axially positioned and having a smaller diameter with respect to said open surface of said first tubular portion, wherein said inner open surface of said connector includes at least one recessed guide surface formed therein;

a second member portion is provided which includes an outer extruded surface coating, said second member portion characterized to include at least one longitudinal radially extending guide surface configured in a complementary manner to said inner open surface and to said recessed guide surface of said connector to be slidably received therethrough; and means for axially interlocking said first tubular member portion and said second member portion along a common portion when said second member is disposed through said connector and within said first tubular member portion.

10. The telescoping member of claim 9, wherein said connector includes a first end of a diameter larger than said open surface of said first tubular member portion and a second end of diameter slightly smaller than said open surface of said first tubular member portion and is further characterized to include a plurality of said recessed guide surfaces which are equidistantly spaced and extending longitudinally through said connector along said inner open surface thereof and having a depth approximately equal to a thickness of said second end and wherein said second member portion is further characterized to includes a plurality of complementary longitudinal radially extending guide surfaces equidistantly spaced to be received within said recessed guide surfaces and are of a radial length to form a bearing surface against said open surface of said first tubular member portion.

11. The telescoping member of claim 10, wherein said axially interlocking means includes at least one aperture surface which extends radially through said first member portion into communication with said open surface and a radially outward extendable button connected to said second member portion which configured to be removably retainably disposed within said aperture surface of said first tubular member portion.

12. The telescoping member of claim 10, wherein said annular connector is press-friction-fit onto said first end in a manner to substantially prevent movement rotational movement between said first tubular member portion and said second member portion.

13. The telescoping member of claim 12, which is characterized to include a plurality of aperture surfaces in said first member portion which share a common axis.

14. The telescoping member of claim 10, wherein said first tubular portion includes an outer extruded plastic surface coating.

15. The telescoping member of claim 10, wherein said outer extruded surface coating is plastic.

16. The telescoping member of claim 9, wherein said at least one longitudinal radially extending guide surface is configured in a complementary manner to said at least one recessed guide surface to prevent rotational movement between the first tubular handle portion and the second handle portion.

17. A telescoping handle, which includes:

a first tubular handle portion having a first end and an inner open surface extending axially inwardly therein from said first end having a predetermined diameter;

an annular connector which is fixably disposed on said first end of said first tubular handle portion and includes an inner open surface axially positioned and having a smaller diameter with respect to said open surface of said first tubular portion, wherein said inner open surface of said connector includes at least one guide surface formed therein; and a second handle portion is provided which includes an outer extruded surface coating configured in a complementary manner to said inner open surface and guide surface of said connector to be slidably received therethrough;

means for axially interlocking said first tubular handle portion and said second handle portion along a common axis when said second handle portion is disposed through said connector and within said first tubular handle portion; and wherein said connector includes a first end of a diameter larger than said open surface of said first tubular handle portion and a second end of diameter slightly smaller than said open surface of said first tubular handle portion and is further characterized to include a plurality of said guide surfaces which are equidistantly spaced and recessed extending longitudinally through said connector along said inner open surface thereof and having a depth approximately equal to a thickness of said second end and wherein said second handle portion is further characterized to includes a plurality of complementary guide surfaces equidistantly spaced to be received within said recessed guide surfaces and are of a radial length to form a bearing surface against said open surface of said first tubular handle portion.

18. A telescoping member, which includes:

a first tubular member portion having a first end and an inner open surface extending axially inwardly therein from said first end having a predetermined diameter;

an annular connector which is fixably disposed on said first end of said first tubular member portion and includes an inner open surface axially positioned and having a smaller diameter with respect to said open surface of said first tubular portion, wherein said inner open surface of said connector includes at least one guide surface formed therein;

a second member portion is provided which includes an outer extruded surface coating configured in a complementary manner to said inner open surface and guide surface of said connector to be slidably received therethrough; and means for axially interlocking said first tubular member portion and said second member portion along a common axis when said second member portion is disposed through said connector and within said first tubular member portion; and wherein said connector includes a first end of a diameter larger than said open surface of said first tubular member portion and a second end of diameter slightly smaller than said open surface of said first tubular member portion and is further characterized to include a plurality of said guide surfaces which are equidistantly spaced and recessed extending longitudinally through said connector along said inner open surface thereof and having a depth approximately equal to a thickness of said second end and wherein said second member portion is further characterized to includes a plurality of complementary guide surfaces equidistantly spaced to be received within said recessed guide surfaces and are of a radial length to form a bearing surface against said open surface of said first tubular member portion.

* * * * *